US005178641A

United States Patent [19]

Konrad et al.

[11] Patent Number: 5,178,641

[45] Date of Patent: Jan. 12, 1993

[54] MIDDLE DISTILLATES OF CRUDE OIL HAVING IMPROVED COLD FLOW PROPERTIES

[75] Inventors: Gerd Konrad, Limburgerhof; Bernd Wenderoth, Lampertheim; Klaus Barthold, Mannheim; Erich Schwartz, Ludwigshafen; Hans-Juergen Raubenheimer, Ketsch; Heinrich Hartmann, Limburgerhof, all of Fed. Rep. of Germany

[73] Assignee: BASF Corporation, Parsippany, N.J.

[21] Appl. No.: 792,540

[22] Filed: Nov. 13, 1991

[30] Foreign Application Priority Data

Nov. 14, 1990 [DE] Fed. Rep. of Germany ..... 4036225

[51] Int. Cl.[5] ..... C10L 1/22

[52] U.S. Cl. ..... 44/392; 44/391; 44/393; 44/394

[58] Field of Search ..... 44/391, 392

[56] References Cited

U.S. PATENT DOCUMENTS 2,892,690 6/1959 Lowe et al. ..... 44/392
3,010,810 11/1961 Stayner et al. ..... 44/392

FOREIGN PATENT DOCUMENTS 261957 3/1988 European Pat. Off. .
283293 9/1988 European Pat. Off. .

*Primary Examiner*—Ellen McAvoy

[57] ABSTRACT

Crude oil middle distillates with improved cold flow properties, containing small amounts of A. conventional flow improver on an ethylene base, and B. copolymers which consist of 10 to 95 mol-% of one or more acrylacrylates or alkylmethacrylates with $C_1$- to $C_{26}$-alkyl chains, and of 5 to 90 mol-% of one or more ethylenically unsaturated dicarboxylic acids or their anhydrides, where the copolymer is reacted to a large extent with one or several primary or secondary amines into the monoamide or amide/ammonia salt of dicarboxylic acid, and the quantitative proportion of A to B is from 40 to 60 up to 95 to 5.

8 Claims, No Drawings

MIDDLE DISTILLATES OF CRUDE OIL HAVING IMPROVED COLD FLOW PROPERTIES

FIELD OF THE INVENTION

The present invention relates to middle distillates of crude oil containing small amounts of a conventional flow improver on an ethylene base and copolymers of ethylenically unsaturated carboxylic acid esters of long-chain n-alcanols and ethylenically unsaturated dicarboxylic acid derivatives, which are distinguished by improved cold flow properties.

BACKGROUND OF THE INVENTION

Middle distillates, such as gas oil, Diesel oil or heating oil, which are obtained from crude oil by distillation have, depending on the source of the crude oil and depending on the type of processing in the refinery, different paraffin contents. The proportion of long-chain n-paraffins in particular determines the cold flow properties of such distillates. During cooling, the n-paraffins are separated in the form of platelet-like interlaced crystals which build up into a three-dimensional network (house of cards structure), where large amounts of still liquid distillate are locked up and immobilized. A decrease of flowability and an increase of the viscosity occurs parallel with the crystallization of the n-paraffins. The supply of middle distillates to the combustion means is made more difficult because of this. The precipitated paraffins plug filters ahead of the combustion means so that in extreme cases it is possible that the entire supply is stopped.

It has been known for a long time that the plugging of the filters at low temperatures can be overcome by the addition of so-called flow improvers. By means of the formation of nuclei, the additives cause the formation of many small paraffin crystals in place of a few large ones. At the same time they change their crystal modification, so that there is no formation of the above described platelets. The paraffin crystals formed in the presence of flow improvers are so small that they can pass through the filters, or they build up into a filter cake which is permeable to the still liquid portion of the middle distillate, so that operation free of disruption is assured even at low temperatures.

Middle distillate cuts are appearing in increasing amounts in the refineries, where the standard flow improvers do not have a sufficient effect or even fail completely. This applies particularly to so-called top draw oil, i.e. fractions with a high final boiling point (F.B.P.>370° C.). However, the boiling properties are not the criteria. It may occur in connection with two fractions with similar boiling point curves but dissimilar provenance of the basic crude oil, that the standard flow improver works well with one oil, but not with the other. In accordance with DIN 51 428, the effectiveness of the flow improver is indirectly expressed by measuring the cold filter plugging points (CFPP).

Ethylene copolymers, known per se, mainly copolymers of ethylene and unsaturated esters such as described in German Patent Disclosure DE-A-21 02 469 or European Patent Disclosure EP-A-84 148, are used as standard cold flow improvers.

However, the technology requires new flow improvers which also show good effectiveness in connection with the above described critical oils.

The use of polymers with linear, saturated side chains with at least 18 carbon atoms for reducing the flow point of paraffin-containing heating oil is known from German Patent Disclosure DE-A-16 45 785. Also recited are: "Reaction products of copolymers of acid anhydrides of unsaturated dicarboxylic acids and mono-olefins or other olefinic unsaturated compounds with an aliphatic amine containing a long hydrocarbon chain". In this case copolymers of mono-olefins are preferred.

In German Patent Disclosure DE-A-25 31 234 the addition of alternating copolymers containing maleic acid diamide or maleic imide structures are recommended as stabilizers in mineral oils, i.e. the carboxyl groups are completely reacted with amines into diamides or imides.

In accordance with U.S. Letters Pat. No. 3,506,625, reaction products of monoamines with maleic acid anhydride polymers to the corresponding imides are also described, where in case of use of less than one mol amine per mol unit of maleic acid anhydride still remaining carboxyl groups are changed to metal salts by neutralization. Alkylvinylether and monovinylhydrocarbons are preferably used for the copolymerization with maleic acid anhydrides.

French Letters Patent 2.592.658 describes mixtures of an ethylene polymer and a reaction product of a primary amine with a copolymer of, for example, acrylic acid lkylesters, diisobutene and maleic acid anhydride and their use as an additive to middle distillates.

Middle distillates are described in European Patent Disclosure EP-A-360 419, which contain polymers of vinylethers with hydrocarbon radicals of 1 to 17 carbon atoms. Alkylacrylates or -methacrylates, among others, are disclosed as co-monomers. However, the examples only describe polymers of alkylvinylethers with up to four carbon atoms in the side chain. These $C_1$- to $C_4$-vinylethers are copolymerized with derivatives of maleic or fumaric acid. No examples of copolymers with derivatives of acrylic acid are provided. The claimed additives can be used in conjunction with other flow improvers.

The use of polymers with at least one amide group from a secondary amine and a carboxyl group as an additive to middle distillates is known from European Patent Disclosure EP-A-283 293. The polymers can be obtained, for example, by copolymerization of unsaturated esters with maleic acid anhydride and subsequent reaction with the secondary amine. Among others, dialkylfumarate and vinylacetate are disclosed as unsaturated ester monomers.

However, these polymers leave a lot to be desired in regard to their effectiveness as cold flow improvers for middle distillates.

For these reasons the problem arose of finding additives to middle distillates with improved efficiency as cold flow improvers.

OBJECT AND SUMMARY OF THE INVENTION

It has been found accordingly that crude oil middle distillates containing small amounts of A: known flow improvers, and B: copolymers consisting of 10 to 95 mol-% of one or more alkylacrylates or alkylmethacrylates with $C_1$- to $C_{26}$-alkyl chains, and of 5 to 90 mol. % of one or more ethylenically unsaturated dicarboxylic acids or their anhydrides, where the copolymer is reacted to a large extent with one or several primary or secondary amines into the monoamide or amide/ammonia salt of dicarboxylic acid fulfill these requirements.

The copolymers B consist of 10 to 95 mol. %, preferably 40 to 95 mol. %, and particularly preferred 60 to 90 mol. % of alkyl(meth)acrylates, of 5 to 90 mol. %, preferably 5 to 60 mol. % and particularly preferred 10 to 40 mol. % of olefinic unsaturated dicarboxylic acids derivatives.

The quantitative proportion of flow improver A to copolymer B lies between 40:60 and 95:5, preferably between 60:40 and 95:5 and particularly preferred between 70:30 and 90:10.

The alkyl groups of the alkyl(meth)acrylates consist of 1 to 26, preferably 4 to 22 and particularly preferred 8 to 18 carbon atoms. They are preferably straight-chain and linear. However, they may also contain up to 20% by weight of cyclical and/or branched portions.

Examples of particularly preferred alkyl(meth)acrylates are n-octyl(meth)acrylate, n-decyl(meth)acrylate, n-dodecyl(meth)acrylate, n-tetradecyl(meth)acrylate, n-hexadecyl(meth)acrylate and n-octadecyl(meth)acrylate, as well as mixtures thereof.

Examples of ethylenic unsaturated dicarboxylic acids are maleic acid, tetrahydrophthalic acid, citraconic acid or itaconic acid or their anhydrides, as well as fumaric acid. Maleic acid anhydride is preferred.

Amines of the formula

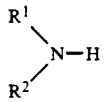

are considered as compounds, where $R^1$ is a straight-chain or branched alkyl radical with 1 to 30, preferably 8 to 26 and particularly preferred 16 to 24 carbon atoms and $R^2$ is hydrogen or $C_1$- to $C_{30}$-alkyl, preferably hydrogen or $C_8$- to $C_{26}$-alkyl and particularly preferred hydrogen or $C_{16}$- to $C_{24}$-alkyl, where $R^1$ and $R^2$ together may also form a ring of 5 to 6 links, which, if required, may contain a hetero-atom from the group oxygen, nitrogen and sulfur. Particularly to be mentioned are morpholine, piperidene, 2-ethylhexylamine, n-octadecylamine, oleylamine, tallow fat amine, n-methyloctadecylamine and preferably behenylamine, dibenylamine and hydrogenated di-tallow fat amine.

Examples of the flow improvers A are the already mentioned polymers described in DE-A-21 02 469 and EP-A-84 148, and copolymers of ethylene with vinylacetate, vinylpropionate, vinylbutyrate, vinylpivalate or with esters of (meth)acrylic acid which derive from alkanols with 1 to 12 carbon atoms. Also suitable are mixtures of several copolymers of ethylene and vinylacetate (EP-A-261 951, Additive A), copolymers of ethylene with α-olefins (EP-A-261 957, Additive D) and the mixtures of terpolymers of ethylene, vinylacetate and diisobutane with oxidized polyethylene wax recited in DE-A-36 24 147. Copolymers of ethylene with vinylacetate or vinylpropionate or ethylhexylacrylate are particularly preferred.

The alkyl(meth)acrylates are easily accessible. They can be obtained by means of the known methods of esterification. For example, a solution of (meth)acrylic acid and an alkanol or a mixture of different alkanols is heated to boiling in an organic solvent with the addition of the usual polymerization inhibitors, for example hydroquinone derivatives and esterification catalysts, such as sulfuric acid, p-toluene sulfonic acid or acid ion exchangers, and the reaction water which forms is removed by azeotropic distillation. The esterification products can mostly be used for polymerization without being cleaned. If a purer ester is required, it can be obtained by washing of the ester solution with alkaline means and water as well as by distillation.

Further possibilities for producing alkyl(meth)aorylates are the reaction of (meth)acrylic acid chloride or anhydride with the corresponding alkanols as well as the reaction, known as interesterification, of low (meth-)acrylic acid esters with the corresponding $C_8$- to $C_{18}$ alkanols, with the addition of acidic or basic catalysts and removal by distillation of the low alkanol.

As a rule it is advantageous to use the dicarboxylic acids in the form of anhydrides to the extent available in copolymerization, for example maleic acid anhydride, itaconic acid anhydride, citraconic acid anhydride and tetrahydrophthalic acid anhydride, because as a rule the anhydrides copolymerize better with the (meth)acrylates. The anhydride groups of the copolymers can then be directly reacted with compounds containing amino or hydroxyl groups.

Reaction of the polymers with amines takes place at temperatures of 50° to 200° C. in the course of 0.3 to 30 hours. The amine is used in this case in amounts of approximately one to two mols per mol of polymerized dicarboxylic acid anhydride, i.e. approximately 0.9 to 2.1 mol/mol. Use of larger or smaller amounts is possible, but does not provide an advantage. If amounts larger than two mols are used, free amine is present. If amounts of less than one mol are used, there is no complete conversion to form monoamide and a correspondingly reduced effect is achieved.

It may be of advantage in some cases if the amide/ammonia salt structure is composed of two different amines. For example, a copolymer of laurylacetate and maleic acid anhydride can be first converted with a secondary amine, such as hydrogenated di-tallow fat amine, into an amide, after which the free carboxyl group from the anhydride is neutralized with another amine, for example 2-ethylhexylamine, to ammonia salt. In the same way the reverse process is conceivable: first, conversion to a monoamide is made with ethylhexylamine, then to an ammonium salt with di-tallow fat amine. In this case at least an amine is preferably used, which has at least one straight-chain, linear alkyl group with more than 16 carbon atoms. It is not important in this case whether or not this amine is present in the composition of the amide structure or as an ammonia salt of the dicarboxylic acid.

Instead of the later conversion of the carboxyl groups or the dicarboxylic acid anhydride with amines to the corresponding amides or amide/ammonia salts, it may be advantageous in some cases to produce the monoamides or the amide/ammonia salts of the monomers and then to polymerize them directly during polymerization. However, in most cases this is technically more expensive, for example because the amines can also become attached to the double bond of the dicarboxylic acids and then copolymerization is no longer possible.

The production of the colymers B takes place in accordance with known discontinuous or continuous polymerization methods, such as mass, suspension, precipitation or solution polymerization, and initiation with the usual radical donors, such as acetylcyclohexanesulfonylperoxide, diacetylperoxidicarbonate, dicyclohexylperoxidicarboate, di-2-ethylhexylperoxidicarbonate, tert.-butylperneodecanoate, 2-2'-azobis(4-methoxy-2,4-dimethyl-valeronitrile), tert.butylperpivalate, tert.- butylper-2-ethyl-hexanoate, tert.butylpermaleinate, 2,2'-azobis(isobutyronitril), bis-(tert.butylperoxide)cyclohexane, tert.-butylperoxiisopropylcarbonate, tert.-butylperacetate, di-cumylperoxide, di-tert.-amylperoxide, p-menthanehydroperoxide, cumolhydroperoxide or tert.butylhydroperoxide and mixtures among these. Generally these initiators are used in amounts of 0.1 to 20% by weight, preferably 0.2 to 15% by weight, in respect to the monomers.

Polymerization as a rule takes place at temperatures of 40° to 400° C., preferably 70° to 300° C., where it is practical to operate under pressure when solvents with boiling temperatures below the polymerization temperature are used. It is practical to perform the polymerization with air excluded, i.e. if processing is not done under boiling conditions, for example in nitrogen or carbon dioxide, because oxygen delays polymerization. The reaction can be accelerated by the simultaneous use of redox initiators, such as benzoin, dimethylaniline, ascorbic acid as well as organically soluble complexes of heavy metals such as copper, cobalt, manganese, iron, nickel and chromium. The amounts normally used lie around 0.1 to 2000 ppm by weight, preferably 0.1 to 1000 ppm by weight. When selecting the initiator or the initiator system, it is practical in connection with the chosen polymerization temperature to see to it that the half-time of the initiator or initiator system is less than three hours.

It is often practical for obtaining low-molecular copolymers to operate in the presence of regulators. Suitable regulators are, for example, allylalcohols such as 1-butene-3-ol, organic mercaptan compounds such as 2-mercaptoethanol, 2-mercaptopropanol, mercaptoacetic acid, mercaptopropionic acid, tert.butylmercaptan, n-butylmercaptan, n-octylmercaptan, n-dodecylmercaptan and tert.-dodecylmercaptan, which generally are used in amounts of 0.1 to 10% by weight.

Apparatus suitable for polymerization consists of, for example, customary mixing vessels with, for example, anchor, blade, impeller or multistage-pulse countercurrent agitators, and for continuous production mixing vessel cascades, tube reactors and static mixers.

Mass polymerization is the simplest polymerization method. In accordance with it the monomers are polymerized in the presence of an initiator and the absence of solvents. In a practical manner all monomers are mixed in the desired composition and a small amount, for example approximately 5 to 10%, is first placed into the reactor, heated to the desired polymerization temperature while stirring and the remaining monomer mixture and the initiator and, if required, the coinitiator as well as the regulator are evenly admixed during 1 to 10 hours, preferably 2 to 5 hours. In this connection it is practicable to admix the initiator as well as the coinitiator separately in the form of solutions in a small amount of a suitable solvent. Then the copolymer can be added directly to the flow improver as a solidified molten mass or after having been placed in a suitable solvent.

A continuous high-pressure method is also suitable for producing the desired copolymers, which permits space-time yields of 1 to 50 kg polymer per liter of reactor and hour. For example, a pressure vessel, a pressure vessel cascade, a pressure pipe or a pressure vessel with a reaction pipe downstream, which is provided with a static mixer, can be used as polymerization apparatus. Polymerization is preferably performed with monomers of (meth)acrylic acid esters and unsaturated dicarboxylic acids or their anhydrides and vinylethers in at least two successive polymerization zones. One polymerization zone can consist of a pressure-proof vessel, the other of a heatable static mixer. Conversions of more than 99% are obtained in this case. For example, a copolymer of (meth)acrylic acid esters and maleic acid anhydride can be produced by continuously supplying the monomers and a suitable initiator to a reactor to two successive reaction zones, for example a reactor cascade, and continuously taking the reaction product from the reaction zone after a loitering time of 2 to 60, preferably 5 to 30 minutes, at temperatures between 200° and 400° C. Polymerization is practically performed at pressures of more than 1 bar, preferably between 1 and 200 bar. The copolymers obtained show solid contents of more than 99% and can then be further converted into the appropriate amides or amide/ammonia salts.

Another simple method for producing the copolymers B is solution polymerization. It is performed in solvents in which the monomers and the formed copolymers are soluble. For this all those solvents are suitable which fulfill this condition and which do not react with the monomers. They are, for example, toluene, xylene, ethylbenzene, cumene, high-boiling aromatic mixtures such as Solvesso® 100, 150 and 200, aliphatic and cycloaliphatic hydrocarbons such as n-hexane, cyclohexane, methylcyclohexane, n-octane, iso-octane, paraffin oils, Shellsol® TD, T and K as well as tetrahydrofuran and dioxane, where tetrahydrofuran and dioxane are particularly well suited for obtaining low-molecular copolymers. When performing the solution polymerization it is practical to place the solvent and a part of the monomer mixture (for example approximately 5 to 20%) first and to admix the remainder of the monomer mixture with the initiator and, if required, the coinitiator, regulator and solvent. It is also possible to admix the monomers individually at different speeds. This is recommended in case of monomers with greatly differing reactivity, as is the case with (meth)acrylates and unsaturated dicarboxylic acids(anhydrides), and when a particularly even distribution of the less reactive vinylether is desired. In this case the less reactive monomer is admixed faster and the more reactive monomer slower. It is also possible to place the entire amount of a monomer, preferably the less reactive anhydride or vinylether, first and to admix only the (meth)acrylate. Finally, it is also possible to place all the monomers and the solvent first and to admix only the initiator and, if required, the coinitiator and regulator (batch processing). When using this type of processing on a larger scale, however, problems in regard to heat removal may occur, so that this type of processing should only be used with low concentrations of the monomers to be polymerized. The concentration of the monomers to be polymerized lies between 10 and 80% by weight, preferably 30 and 70% by weight. The solid copolymers can be obtained without problems by evaporation of the solvent. However, it is practical to select a solvent for polymerization which is compatible with the middle distillate, so that the polymerisate solution can be directly added to the middle distillate. Solution polymerization is the preferred type of producing copolymers from (meth)acrylates and dicarboxylic acids(anhydrides).

There is the requirement in technology to provide the additives in accordance with the invention, consisting of a flow improver A and a copolymer B, in a form which is easy to handle. For this purpose the polymers A and B should be available in the form of one concentrate, since the use of two concentrates—one each for polymer A and polymer B—makes handling more difficult. Because of possible incompatibility of the polymers A and B, phase separation may occur if the two polymers are purely admixed in a common solvent. If necessary this can be suppressed by means of suitable solvents and/or additives. For example, alkanols, such as iso-butanol, n-hexanol, 2-ethylhexanol, iso-decanol and their adducts with ethylene oxide, propylene oxide and/or butylene oxide, alkylphenol and their adducts with ethylene oxide, propylene oxide and/or butylene oxide, as well as semi-esters or di-esters of dicarboxylic acids with alkanols or (oligo)alkyleneoxide semi-esters such as mono or dibutylphthalate, mono- or di-2-ethylhexylphthalate or di-(2-methoxyethyl)-phthalate are suitable.

Another method of preventing possible phase separation consists in grafting the copolymer B at least in part on the flow improver. Mass or solution polymerization is preferably used for grafting. Polymerization can be performed in accordance with batch or feed processing. With batch processing, the entire amount of flow improver A on which the graft is to be made is placed first, together with the monomers, and the initiator and, if required, the coinitiator and regulator are admixed later. With feed processing, the entire amount of flow improver A on which the graft is to be made is placed first, if desired together with a portion of the monomers, and the rest of the monomers, initiator and, if required, the coinitiator and regulator are admixed later. The reaction with the amines takes place after finishing polymerization.

As already mentioned, it is not necessary to graft the copolymer B on the entire portion of the flow improver A. For example, at the ratio A:B of 90:10, the copolymer B is grafted on only a portion of 2 to 20% by weight of the entire amount of A for reasons of the space-time yield. However, at a ratio of A:B of 40:60 on a portion of 30 to 100% by weight of the total amount of A.

It is also unnecessary to graft the entire amount of polymer B on a portion of the flow improver A. This is difficult anyway, because in general the graft yield does not reach 100%, so that it is possible that, besides graft copolymerisates and unreacted or admixed flow improver A, there is also non-grafted copolymer B in the concentrates described.

The K values (according to H. Fikentscher, *Cellulose Chemistry*, Vol. 13, pp. 58 to 64 and 71 to 74 (1932)), determined in a 2% (vol. by weight) xylolic solution of the copolymerisates B, lies between 10 and 50, preferably between 10 and 40 and particularly preferred between 13 and 30. The particularly preferred range corresponds to molecular weights between approximately 5000 and 25000 g/mol (numerical mean values determined by gel permeation chromatography against polystyrol standards).

The additives A and B in accordance with the invention are added to crude oil middle distillates in amounts of 50 to 5000 ppm, preferably 100 to 2000 ppm.

The middle distillates in accordance with the invention and containing small amounts of a flow improver A and a copolymer B may, depending on their intended use, contain other additives or added materials such as dispersants, anti-foaming additives, corrosion protection agents, anti-oxidants, dyes, and the like.

The invention will be explained by means of the following examples.

DETAILED DESCRIPTION

Production of Copolymers B in Accordance with the Invention

Example 1

In a reactor provided with an agitator, heater and feed device, 177.5 g of laurylacrylate (n-alkylacrylate mixture, prepared from a commercially available fatty alcohol mixture consisting maximally of 1.5% by weight of n-decanol, 51 to 57% by weight of n-dodecanol, 41 to 47% by weight of n-tetradecanol and maximally 1.5% by weight of n-hexadecanol), 28.5 g of maleic acid anhydride and 88.3 g of Solvesso® 150 (high-boiling aromatic mixture of the ESSO company) were heated to 80° C. in a weak nitrogen flow while being agitated and a solution of 0.6 g of azoisobutyronitrile in 38.3 g of Solvesso® 150 was evenly admixed over a period of 4 hours. Subsequently a solution of 0.4 g of azoisobutyronitrile in 11.5 g of Solvesso® 150 was added and heating continued at 80° C. for one hour, and the mixture was thinned with 69 g of Solvesso® 150. A clear, yellowish solution of approximately 50% by weight was obtained. The K value of the polymer was 22.9; the mol ratio of acrylate to maleic acid anhydride was approximately 70:30.

Example 2

In a reactor in accordance with Example 1, 84.4 g of laurylacrylate, 17.6 g of maleic acid anhydride and 102 g of Solvesso® 150 were heated to 100° C. in a weak nitrogen flow while being agitated and a solution of 0.6 g of tert.-butylper-2-ethylhexanoate in 17 g of Solvesso® 150 was evenly admixed over a period of 4 hours, and a solution of 97.8 g laurylacrylate in 13.6 g Solvesso® 150 was evenly admixed over a period of two hours. Subsequently a solution of 0.4 g of tert.-butylper-2-ethylhexanoate in 5 g of Solvesso® 150 was added and heating at 100° C. was continued for one hour and the mixture was thinned with 61.6 g of Solvesso® 150. A clear yellowish polymer solution of approximately 50% by weight was obtained. The K value of the polymer was 16.0; the mol ratio of acrylate to maleic acid anhydride was approximately 80:20.

Example 3

Same as Example 2, but instead of Solvesso® 150, a high-boiling n- and iso-paraffin mixture of the Shell company (Shellsol® K) was used as solvent.

A clear, light-yellow viscous polymer solution of approximately 50% by weight was obtained. The K value of the polymer was 25.9; the mol ratio of acrylate to maleic acid anhydride was approximately 80:20.

Example 4

Same as Example 3, but in place of laurylacrylate, an n-alkylacrylate mixture, prepared from a commercially available fatty alcohol mixture of the following composition, was used:

5 to 8% by weight of n-octanol, 5 to 7% by weight of n-decanol, 44 to 50% by weight of n-dodecanol, 14 to 20% by weight of n-tetradecanol, 8 to 10% by weight of n-hexadecanol and 8 to 12% by weight of n-octadecanol.

A clear, light-yellow viscous solution of approximately 50% by weight was obtained. The K value of the polymer was 23.8; the mol ratio of acrylate to maleic acid anhydride was approximately 80:20.

Example 5

In a reactor in accordance with Example 1, 305 g of laurylacrylate, 176.4 g of maleic acid anhydride and 120 g of toluene were heated to 100° C. in a weak nitrogen flow and a solution of 2.4 g of tert.-butylper-2-ethylhexanoate in 40 g of toluene was evenly admixed over a period of three hours. Subsequently the mixture was heated to boiling and a solution of 0.96 g of tert.-butylperbenzoate in 46 g of toluene was added, heating continued for two hours at 125° C. and the mixture thinned with 270 g toluene. A clear, brown polymer solution of approximately 50% by weight was obtained. The K value of the polymer was 32.2; the mol ratio of acrylate to maleic acid anhydride was approximately 40:60.

Example 6

Grafting of laurylacrylate and maleic acid anhydride on a flow improver, consisting of 60% by weight of ethylene and 40% by weight of vinylpropionate with a mean molecular weight of approximately 2500 (determined by vapor pressure osmometry)=Fl(A).

In a reactor in accordance with Example 1, 196.8 g of the flow improver Fl(A), 34.5 g of maleic acid anhydride and 91.5 g of Solvesso® 150 were heated in a weak nitrogen flow to 100° C. while being agitated. 77 g of a mixture of 358.7 g of laurylacrylate and 40 g of Solvesso® 150 and the rest of the mixture were evenly admixed over a period of 2 hours. Simultaneously, 1.18 g of tert.-butylper-2-ethylhexanoate, dissolved in 65 g of Solvesso® 150, was evenly admixed over a period of 4 hours. Subsequently a solution of 0.38 g of tert.-butylper-2-ethylhexanoate in 14.8 g of Solvesso® 150 was added, heating continued for an hour and the solution thinned with 379 g of Solvesso® 150. A slightly cloudy polymer solution of approximately 50% by weight, having a K value of 25.4, was obtained.

Examples 7 to 17

Reaction of the Copolymers of Examples 1 to 4 with Amines

The reaction was performed by reacting the above polymer solutions with the appropriate amount of the amine and agitating at 100° C. until the anhydride bands had disappeared from the infrared spectrum.

| Example No. | Polymer from Example No. | Amine | Mol Amine per Mol Msa | Reaction time (h) |
|---|---|---|---|---|
| 7 | 1 | A | 2 | 3 |
| 8 | 2 | A | 2 | 3 |
| 9 | 2 | A | 1 | 3 |
| 10 | 3 | A | 2 | 3 |
| 11 | 3 | A | 1 | 3 |
| 12 | 3 | O | 1 | 2 |
| 13 | 3 | B | 1 | 2.5 |
| 14 | 4 | A | 2 | 3 |
| 15 | 6 | A | 1 | 3 |
| 16 | 6 | A | 2 | 3 |
| 17 | 5 | A | 1 | 3 |

Example 18

81.3 g of the polymer solution of Example 15 were mixed with 109.7 g of Fl(A) and 109.7 g of Solvesso® 150 at 60.C. A mixture, cloudy at room temperature, was obtained consisting of a total of 80 parts flow improver Fl(A) and 20 parts copolymer B. The mixture is stable at room temperature for more than 10 weeks.

Example 19

As in Example 18, but with 76 g of the polymer solution of Example 16, 121.1 g of Fl(A) and 121.1 g of Solvesso® 150.

Example 20

25 g of a 50% by weight polymer solution in accordance with Example 7 were agitated for 30 minutes at 40° C. with 0.99 g of 2-ethylhexylamine and 0.99 g of Solvesso® 150. The polymer is thereby transferred into the ester/ammonia salt. In this example the monoamide is formed by means of amine A, the ammonia salt with 2-ethylhexylamine.

Example 21

100 g of a polymer solution of 50% by weight in accordance with Example 1 were reacted at room temperature and with agitation with 9.1 g (approximately 1 mol per mol of maleic acid anhydride) of ethylhexylamine, heated to 100° C. and agitated for 30 minutes, at the end of which formation of the monoamide was completed. Subsequently, 35.3 g of amine A (1 mol per mol of maleic acid anhydride) were added and the mixture was agitated for 30 minutes while slowly cooling to room temperature. In this example the monoamide is formed by means of ethylhexylamine, the ammonia salt with amine A.

Amine A Commercially available amine mixture of a hydrogenated di-tallow fat-amine with the following average chain length distribution: 1% n-$C_{12}$, 4% n-$C_{14}$, 31% n-$C_{16}$, 59% n-$C_{18}$, the rest is unsaturated Amine B Commercially available behenylamine with the following average chain length distribution: 1.3% n-$C_{14}$, 4.7% n-$C_{16}$, 42% n-$C_{18}$, 12% n-$C_{20}$ and 40% n-$C_{22}$ Amine O n-octadecylamine

APPLICATION EXAMPLES

The following meanings apply to what follows:

FI Flow improver, in particular

FI(A) Ethylene/vinylpropionate (with aprx. 40% by weight of vinylpropionate) of a mean molecular weight of approximately 2500 (determined by vapor pressure osmometry)

FI(B) Ethylene/vinylacetate (with aprx. 30% by weight of vinylacetate) of a mean molecular weight of approximately 2500

The flow improvers FI(A) and FI(B) are commercially available products, for example the Keroflux® brands of BASF.

Heating oil and Diesel fuel of a quality commercially available in West Germany were used as middle distillates. They have been designated as middle distillates I, II, III and IV.

| | Middle Distillate | | | |
|---|---|---|---|---|
| | I | II | III | IV |
| Cloud point (°C.) | +6 | +4 | +4 | +5 |
| CFPP (°C.) | 0 | −2 | −1 | −2 |
| Initial boiling point (°C.) | 155 | 131 | 169 | 174 |
| 20% boiling point (°C.) | 232 | 216 | 222 | 219 |
| 50% boiling point (°C.) | 280 | 262 | 262 | 272 |
| 90% boiling point (°C.) | 352 | 346 | 351 | 365 |

-continued

| | Middle Distillate | | | |
|---|---|---|---|---|
| | I | II | III | IV |
| Final boiling point (°C.) | 382 | 375 | 381 | 385 |

TEST METHOD

The cold filter plugging point (CFPP) in accordance with DIN 51, 428 was measured. The results are combined in the Table below.

TABLE

| Test No. | Additive | Dosage (ppm)* | CFPP (°C.) in the Middle Distillate I | II | III | IV |
|---|---|---|---|---|---|---|
| 1 | Without | — | 0 | (−2) | (−1) | (−2) |
| 2 | FI(A) | 300 | (−3) | (−2) | (−2) | (−2) |
| 3 | FI(A) | 500 | (−3) | (−2) | (−2) | (−3) |
| 4 | FI(B) | 500 | (−3) | (−4) | (−4) | (−2) |
| 5 | Copolymer 7 | 500 | (+3) | — | — | — |
| 6 | FI(A) | 250 | (−16) | — | — | — |
| | Copolymer 7 | 250 | | | | |
| 7 | FI(A) | 400 | (−16) | (−17) | (−15) | (−14) |
| | Copolymer 7 | 100 | | | | |
| 8 | FI(A) | 450 | (−14) | — | — | — |
| | Copolymer 7 | 50 | | | | |
| 9 | FI(A) | 475 | (−13) | — | — | — |
| | Copolymer 7 | 25 | | | | |
| 10 | FI(B) | 400 | (−14) | — | — | — |
| | Copolymer 7 | 100 | | | | |
| 11 | FI(A) | 400 | (−18) | (−17) | (−17) | (−15) |
| | Copolymer 8 | 100 | | | | |
| 12 | FI(A) | 400 | (−16) | — | — | — |
| | Copolymer 9 | 100 | | | | |
| 13 | FI(A) | 400 | (−17) | (−15) | (−15) | (−15) |
| | Copolymer 10 | 100 | | | | |
| 14 | FI(A) | 160 | (−13) | — | — | — |
| | Copolymer 10 | 40 | | | | |
| 15 | FI(A) | 400 | (−15) | — | — | — |
| | Copolymer 11 | 100 | | | | |
| 16 | FI(A) | 400 | (−14) | — | — | — |
| | Copolymer 12 | 100 | | | | |
| 17 | FI(A) | 400 | (−16) | — | — | — |
| | Copolymer 13 | 100 | | | | |
| 18 | FI(A) | 400 | (−13) | — | — | — |
| | Copolymer 14 | 100 | | | | |
| 19 | FI(A) | 400 | (−8) | — | — | — |
| | Copolymer 17 | 100 | | | | |
| 20 | Copolymer 18 | 500 | (−15) | — | — | — |
| 21 | Copolymer 19 | 500 | (−17) | — | — | — |
| 22 | FI(A) | 400 | (−14) | — | — | — |
| | Copolymer 20 | 100 | | | | |
| 23 | FI(A) | 400 | (−17) | — | — | — |
| | Copolymer 21 | 100 | | | | |

*50% by weight solutions of each one of the flow improvers FI(A) and FI(B) as well as of the copolymers were admixed, i.e. the admixture of the active substance corresponds to one-half of the values recited in the Table.

As shown by the above examples, the conventional flow improvers FI(A) and FI(B) show unsatisfactory effects in the middle distillates. Adding only the copolymers of the invention even worsens the CFPP of the middle distillates. The synergistic effect of the flow improvers and the copolymers of the invention are made clear by Examples 6 to 23.

What is claimed is:

1. Crude oil middle distillates with improved cold flow properties, containing small amounts of A. conventional flow improver on an ethylene base, and B. copolymers which consist of 10 to 95 mol. % of one or more alkylacrylates or alkylmethacrylates with $C_1$- to $C_{26}$-alkyl chains, and of 5 to 90 mol. % of one or more ethylenically unsaturated dicarboxylic acids or their anhydrides, where the copolymer is reacted to a large extent with one or several primary or secondary amines into the monoamide or amide/ammonia salt of dicarboxylic acid, and the quantitative proportion of A to B is from 40 to 60 up to 95 to 5.

2. Crude oil middle distillates in accordance with claim 1, characterized in that the copolymers B consist of 40 to 95 mol %of alkyl(meth)acrylates and of 5 to 60 mol. % of ethylenically unsaturated dicarboxilic acid derivatives.

3. Crude oil middle distillates in accordance with claim 1, characterized in that the alkyl(meth)acrylates have straightchain, linear $C_4$- to $C_{22}$-alkyl groups.

4. Crude oil middle distillates in accordance with claim 1, characterized in that the ethylenically unsaturated dicarboxylic acids or their derivatives in the copolymers B are reacted with primary or secondary alkylamines with at least one linear hydrocarbon chain with at least 16 carbon atoms to form monoamide to the greatest possible extent.

5. Crude oil middle distillates in accordance with claim 1, characterized in that the ethylenically unsaturated dicarboxylic acids or their derivatives in the copolymers B are reacted with primary or secondary alkylamines with at least one linear hydrocarbon chain with at least 16 carbon atoms to form amide/ammonia salt to the greatest possible extent.

6. Crude oil middle distillates in accordance with claim 1, characterized in that the conventional flow improvers are copolymers of ethylene with vinylacetate, vinylpropionate or ethylhexylacrylate.

7. Crude oil middle distillates in accordance with claim 1, characterized in that the copolymers are grafted from 0 to 100% on the conventional flow improvers.

8. Crude oil middle distillates in accordance with claim 1, characterized in that crude oil middle distillates contain the flow improvers A and the copolymers B together in shares of 50 to 5000 ppm.

* * * * *